US008402603B1

(12) United States Patent
Meek

(10) Patent No.: US 8,402,603 B1
(45) Date of Patent: Mar. 26, 2013

(54) VACUUM CLEANER NOZZLE

(76) Inventor: Christine I. Meek, Peoria, AZ (US)

( * ) Notice: Subject to any disclaimer, the term of this patent is extended or adjusted under 35 U.S.C. 154(b) by 325 days.

(21) Appl. No.: 12/825,792

(22) Filed: Jun. 29, 2010

(51) Int. Cl.
*A47L 9/02* (2006.01)

(52) U.S. Cl. ..... 15/415.1; 15/374

(58) Field of Classification Search ..... 15/374, 15/415.1
See application file for complete search history.

(56) References Cited

U.S. PATENT DOCUMENTS 2,878,504 A * 3/1959 Godfrey ..... 15/210.1
4,374,446 A 2/1983 Copperman
4,402,105 A 9/1983 Garbacik
4,606,092 A * 8/1986 Henning ..... 15/322
4,694,529 A 9/1987 Choiniere
5,502,870 A 4/1996 Ragner et al.
5,755,007 A 5/1998 Dyson
5,970,577 A * 10/1999 Kim ..... 15/398
6,038,732 A 3/2000 McKnight et al.
6,763,549 B1 * 7/2004 Peters ..... 15/374

* cited by examiner

*Primary Examiner* — William Gilbert
*Assistant Examiner* — Patrick Maestri
(74) *Attorney, Agent, or Firm* — Parsons & Goltry; Michael W. Goltry; Robert A. Parsons

(57) ABSTRACT

A vacuum cleaner nozzle to clean a stair structure that includes a horizontal tread that meets a vertical riser at an inward corner includes a nozzle body having a business end formed with opposed upper and lower extremities forming an angle with one another and meeting at an outward corner. The opposed upper and lower extremities and the outward corner are to be concurrently applied to the vertical riser, the horizontal tread, and the inward corner, respectively. An unbroken front suction opening is formed in the upper extremity, the lower extremity, and the outward corner to assure a concurrent suction along substantially the entire height of the vertical riser, substantially the entire width of the horizontal tread, and the inward corner.

9 Claims, 3 Drawing Sheets

VACUUM CLEANER NOZZLE

FIELD OF THE INVENTION

The present invention relates to vacuum cleaners and, more particular, to vacuum cleaner attachment nozzles.

BACKGROUND OF THE INVENTION

A vacuum cleaner is a device that uses an air pump to create a partial vacuum to remove surface dust and dirt through suction applied to a cleaning head or to a vacuum hose. Vacuums are excellent for cleaning floors, including carpeted floors, wooden floors, tile floors, and the like. Regardless of the type of vacuum cleaner, most incorporate a vacuum hose that may be used with a variety of specialized suction heads or attachments useful for specialized cleaning purposes.

While vacuum cleaners prove exemplary and highly useful in cleaning floors and other horizontal surfaces, cleaning stairs with standard vacuum cleaners and standard vacuum hose suction head or attachments has long proved a difficult task. A stairway or stairs consist of a flight or series of steps for going from one level to another, as in a building. The steps are characterized by alternating horizontal treads and risers, which must be periodically cleaned. Although standard vacuum cleaning heads and vacuum hose attachments of standard vacuum cleaners prove adequate for cleaning horizontal surfaces, including horizontal treads of stairs, cleaning the vertical risers with standard vacuum heads and standard vacuum hose attachments has long proved cumbersome and challenging.

SUMMARY OF THE INVENTION

In a stair structure including a horizontal tread, having a width, that meets a vertical riser, having a height, at an inward corner, a vacuum cleaner nozzle constructed and arranged in accordance with the principle of the invention includes a nozzle body having a business end formed with opposed upper and lower extremities forming an angle with one another and meeting at an outward corner. The opposed upper and lower extremities and the outward corner are to be concurrently applied to the vertical riser, the horizontal tread, and the inward corner, respectively. An unbroken front suction opening is formed in the upper extremity, the lower extremity, and the outward corner to assure a concurrent suction along substantially the entire height of the vertical riser, substantially the entire width of the horizontal tread, and the inward corner. The front suction opening has a width that is substantially the same along the upper extremity, the lower extremity, and the outward corner. The nozzle body is further formed with a vacuum hose connecting end opposite to the business end.

In a stair structure including a horizontal tread, having a width, that meets a vertical riser, having a height, at an inward corner, a vacuum cleaner nozzle constructed and arranged in accordance with the principle of the invention includes a nozzle body having a business end formed with opposed upper and lower extremities forming an angle with one another and meeting at an outward corner. The opposed upper and lower extremities and the outward corner are to be concurrently applied to the vertical riser, the horizontal tread, and the inward corner, respectively. The upper extremity has a first length substantially equal to the height of the vertical riser, and the lower extremity has a second length substantially equal to the width of the horizontal tread. An unbroken front suction opening is formed in the first length of the upper extremity, the second length of the lower extremity, and the outward corner to assure a concurrent suction along substantially the entire height of the vertical riser, substantially the entire width of the horizontal tread, and the inward corner. The front suction opening has a width that is substantially the same along the first length of the upper extremity, the second length of the lower extremity, and the outward corner. The nozzle body is further formed with a vacuum hose connecting end opposite to the business end.

In a stair structure including a horizontal tread, having a width, that meets a vertical riser, having a height, at an inward corner, a vacuum cleaner nozzle constructed and arranged in accordance with the principle of the invention includes a nozzle body having a business end formed with opposed vertical and horizontal extremities forming an angle with one another and meeting at an outward corner. The opposed vertical and horizontal extremities and the outward corner are to be concurrently applied to the vertical riser, the horizontal tread, and the inward corner, respectively. The vertical extremity has a first length extending from the outward corner to a first outer end of the vertical extremity of the nozzle body, and the horizontal extremity has a second length extending from the outward corner to a second outer end of the horizontal extremity of the nozzle body. The first length of the vertical extremity is substantially equal to the height of the vertical riser, and the second length of the horizontal extremity is substantially equal to the width of the horizontal tread. An unbroken front suction opening is formed in the first length of the vertical extremity, the second length of the horizontal extremity, and the outward corner to assure a concurrent suction along substantially the entire height of the vertical riser, substantially the entire width of the horizontal tread, and the inward corner. The front suction opening has a width that is substantially the same along the first length of the vertical extremity, the second length of the horizontal extremity, and the outward corner. The nozzle body further includes a vacuum hose connecting end opposite to the business end. In a particular embodiment, the height of the riser is less than the width of the tread, and the first length of the vertical extremity is less than the second length of the horizontal extremity.

BRIEF DESCRIPTION OF THE DRAWINGS

Referring to the drawings.

DETAILED DESCRIPTION

Figure 1:
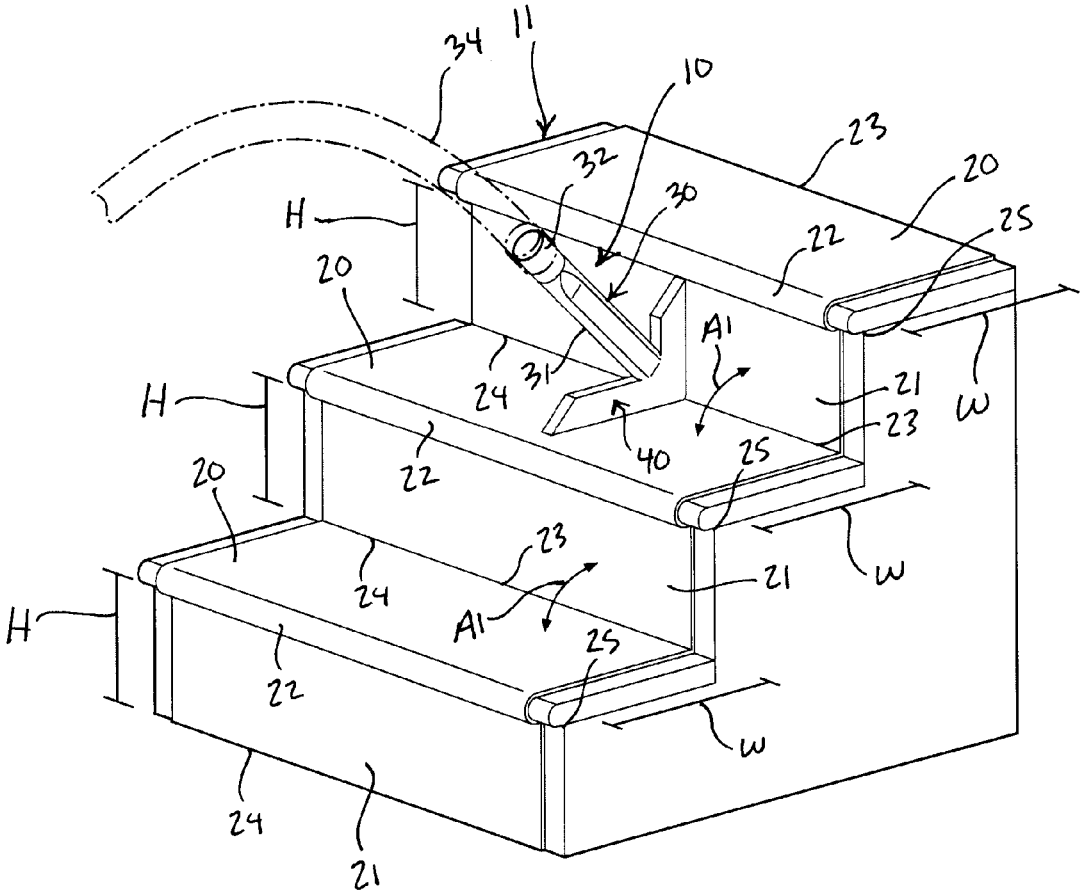
FIG. 1 is perspective view of a vacuum cleaner nozzle constructed and arranged in accordance with the principle of the invention and shown as it would appear in use cleaning a flight of stairs.

Turning now to the drawings, in which like reference characters indicate corresponding elements throughout the several views, attention is first directed to FIG. 1 illustrating a vacuum cleaner nozzle 10 constructed and arranged in accordance with the principle of the invention and shown as it would appear in use cleaning stairs denoted generally at 11. In general, stairs 11 consists of a flight or series of steps for going from one level to another, as in a building. The steps forming stairs 11 are characterized by alternating horizontal treads 20 and vertical risers 21. Treads 20 each have a width W extending from a nosing 22 and an inner edge 23 thereof, and risers 21 each have a height H extending from a lower edge 24 to an upper edge 25 thereof that meets nosing 22 of a corresponding tread 20. Between each tread 20 and riser 21 inner edge 23 meets lower edge 24 at an inward corner formed therebetween, in which the corresponding tread 20 extends horizontally outward from the inward corner formed at the intersection of edges 23, 24, and the corresponding riser 21 extends vertically upward from the inward corner formed at the intersection of edges 23, 24. Each corresponding horizontal tread 20 and vertical riser forms an inward angle A1 with one another meeting at the inward corner formed at the intersection of corresponding edges 23, 24. As each tread 20 is horizontal and each riser 21 is vertical, inward angle A1 formed between each corresponding tread 20 and riser 21 is substantially 90 degrees.

Set forth for purposes of orientation and reference in connection with the ensuing detailed description of the preferred embodiment of the instant invention, the foregoing brief description of stairs 11 is intended to be generally representative of typical stairs for going from one level to another, as in a building. Details not specifically illustrated and described will be readily understood and appreciated by those skilled in the art.

Vacuum nozzle 21 is used with a vacuum cleaner to clean stairs 11 through suction. Vacuum nozzle 21 consists of a nozzle body 30, which is formed of plastic or other like or similar material or combination of materials having the properties of resilience, substantial rigidity, and impact resistance. Nozzle body 30 is preferably an integral body formed by molding, such as injection molding.

Figure 2:
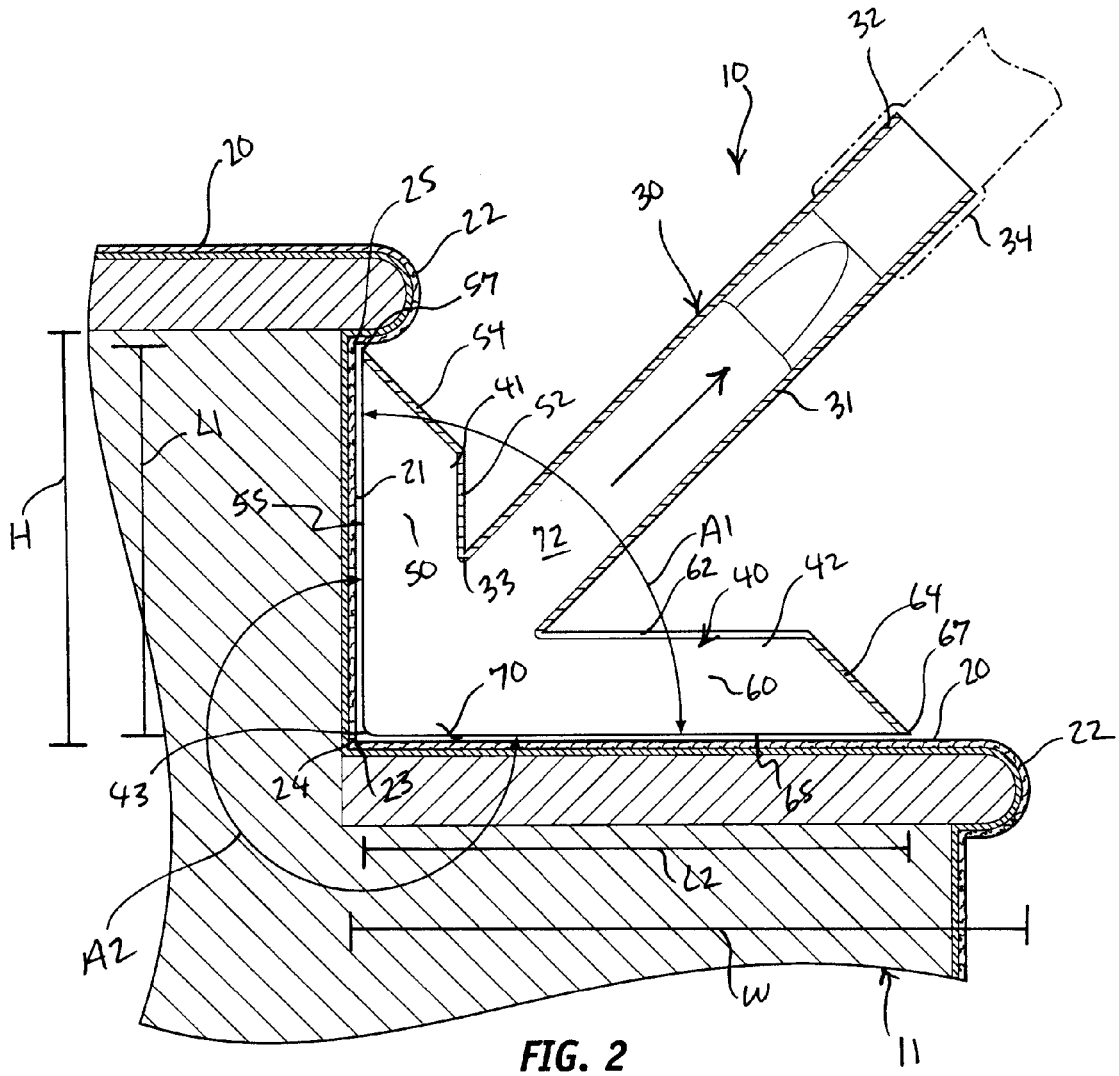
FIG. 2 is a vertical section view of the vacuum cleaner nozzle of FIG. 1 shown as it would appear in use cleaning a flight of stairs.
Figure 3:
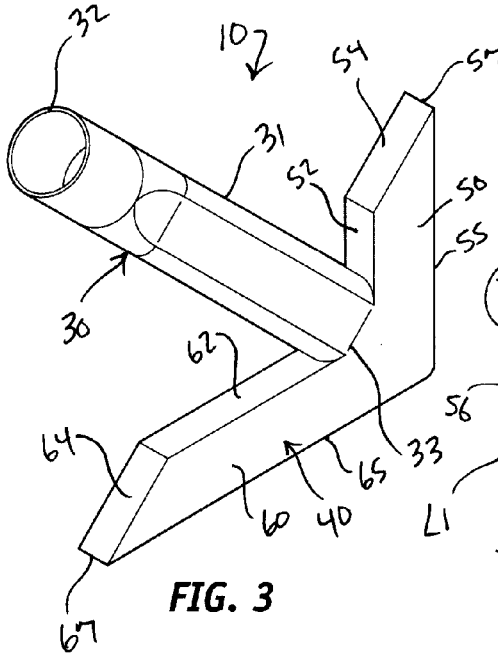
FIG. 3 is a rear perspective view of the vacuum cleaner nozzle of FIG. 1.
Figure 4:
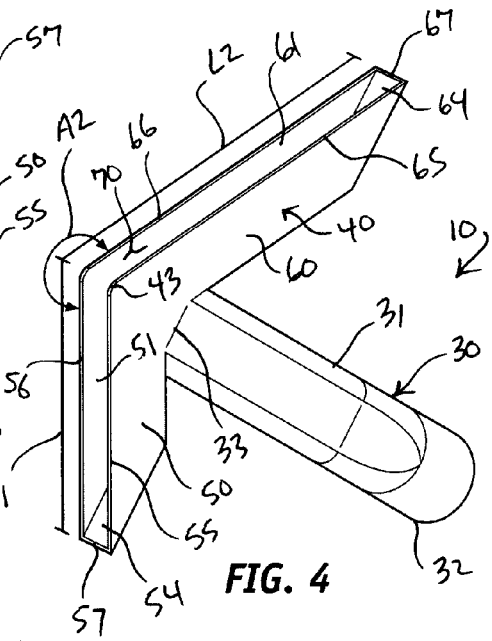
FIG. 4 is a front perspective view of the vacuum cleaner nozzle of FIG. 1.
Figure 5:
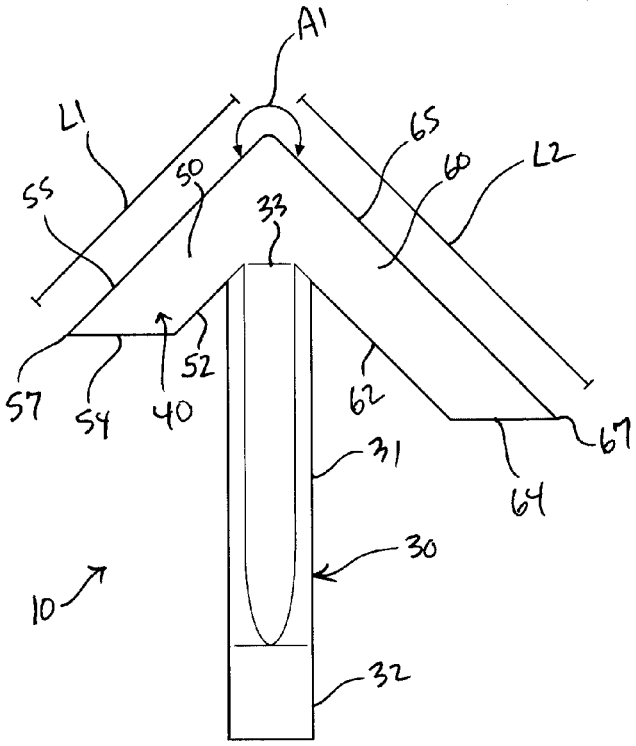
FIG. 5 is a right side elevation view of the vacuum cleaner nozzle of FIG. 1, the opposite left side elevation view being substantially the same thereof.
Figure 6:
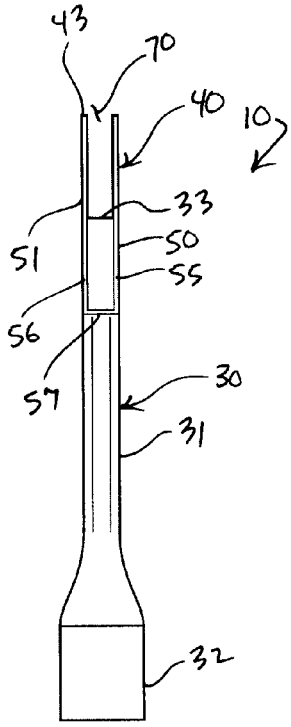
FIG. 6 is a top plan view of the vacuum cleaner nozzle of FIG. 1.

Nozzle body 30 is hollow as shown in FIG. 2 and, with additional reference to FIGS. 3-5, consists of an elongate conduit 31 that has and extends between an inner end 32 and an opposed outer end 33, which is formed with a working or business end 40. Inner end 32 is enlarged, and conduit 31 is then comparatively narrow along the majority of the remaining length of conduit 31 to outer end 33, as shown in FIG. 6. Inner end 32 is a vacuum hose connecting end of conduit 31 of nozzle body 30, and is connectable to a vacuum hose in the normal and customary manner to apply suction through nozzle body 30 from business end 40 formed in outer end 33 of conduit 31 to inner end 32 of conduit 31. As a matter of illustration and reference, FIGS. 1 and 2 illustrate a vacuum hose 34, depicted in phantom outline, coupled to inner end 32 of nozzle 10 in a standard and well known manner for applying suction to nozzle 10 from a standard vacuum cleaner (not shown) coupled to vacuum hose 34. As seen in FIG. 6, business end 40 has substantially the same narrow profile as the narrow length of conduit 31 extending from enlarged inner end 32 to outer end 33 for producing an aggressive suction through nozzle 10.

Business end 40 includes opposed, integrally formed upper and lower extremities 41 and 42 that meet at an outward corner 43. Upper extremity 41 is a vertical extremity of nozzle body 30 and extends vertically upward from outer end 33 and outward corner 43, and lower extremity is a horizontal extremity of nozzle body 30 and extends horizontally rearward from outer end 33 and outward corner 42. Upper and lower extremities 41 and 42 form an angle with one another meeting at outward corner 43. Because upper extremity 41 is vertical and lower extremity 42 is horizontal, the angle formed between upper and lower extremities 41 and 42 is substantially 90 degrees.

Referencing FIGS. 3 and 4 in relevant part, upper extremity 41 is formed by opposed parallel sidewalls 50 and 51 that extend forward from an upstanding backwall 52, each of which are integrally formed with outer end 33 of conduit 31. Sidewall 50 and 51 and backwall 52 extend vertically upward from outer end 33 and terminate with an endwall 54 forming a closed upper end of upper extremity 41. Sidewalls 50 and 51 extend forward from outer end 33 of conduit 31 and backwall 52 and terminate with opposed, straight, spaced-apart, parallel marginal edges 55 and 56, and endwall 54 extends forward and upward from backwall 52 and terminates with a horizontal edge 57. Edges 55 and 56 of sidewalls 50 and 51, respectively, are straight edges, which extend vertically upward from outward corner 43 to horizontal edge 57 of endwall 54. Upper extremity 41 of nozzle 10 defines a length L1 of business end 40 of nozzle 10, which extends from outward corner 43 to horizontal edge 57 of endwall 54.

Lower extremity 42 is formed by opposed parallel sidewalls 60 and 61 that extend downward from a horizontal top wall 62, each of which are integrally formed with outer end 33 of conduit 31. Sidewalls 60 and 61 meet sidewalls 50 and 51, respectively, at outward corner 43 and outer end 33 of conduit 33, and are integral with sidewalls 50 and 51, respectively. Sidewall 60 and 61 and top wall 62 extend horizontally rearward from outer end 33 and terminate with an endwall 64 forming a closed outer end of lower extremity 42. Sidewalls 60 and 61 extend downward from outer end 33 of conduit 31 and top wall 62 and terminate with opposed, spaced-apart, straight, parallel marginal edges 65 and 66, and endwall 64 extends downward and rearward from top wall 62 and terminates with a horizontal edge 67. Edges 65 and 66 of sidewalls 60 and 61, respectively, are straight edges and extend horizontally rearward from outward corner 43 to horizontal edge 67 of endwall 64. Lower extremity 42 defines a length L2, which extends from outward corner 43 to horizontal edge 67 of endwall 64. According to the principle of the invention, length L1 of upper extremity 41 is chosen such that it is substantially equal to height H of each riser 21 of stairs 11 illustrated in FIG. 1, and length L2 of lower extremity 42 is chosen such that it is substantially equal to width W of each tread 20 of stairs 11.

Marginal edges 55 and 56 of upper extremity 41 of nozzle body 30 extend vertically downward from horizontal edge 57 of endwall 54 meeting marginal edges 65 and 66 of lower extremity 42 of nozzle body 30 at outward corner 43, and marginal edges 65 and 66 of lower extremity 42 extend horizontally rearward with respect to marginal edges 55 and 56 of upper extremity 41 from outward corner 43 to horizontal edge 67 of endwall 64 thereby forming in upper and lower extremities 41 and 42 an angle A2 with one another referenced in FIGS. 4 and 5, which is an outward angle that extends from, as best seen in FIG. 4, marginal edges 55 and 56 of upper extremity 41 outwardly to marginal edges 65 and 66 of lower extremity 42. As marginal edges 55 and 56 of upper extremity 41 of nozzle body 30 extend vertically from horizontal edge 57 of endwall 54 to outward corner 43 and marginal edges 65 and 66 of lower extremity 42 extend horizontally rearward with respect to marginal edges 55 and 56 of upper extremity 41 from outward corner 43, outward angle A2 is substantially 270 degrees, in accordance with the principle of the invention.

Edges 55-57 of upper extremity 41, edges 65-67 of lower extremity 42, and outward corner 43 formed by and between edges 55 and 56 of upper extremity 41 and edges 65 and 66 of lower extremity 42 cooperate to form the outer end of business end 40 of nozzle 10, and further cooperate to bound an unbroken front suction opening 70 in the front end of business end 40 of nozzle body 30 of nozzle 10 illustrated in FIG. 4. Suction opening 70 is formed in and extends along length L1 of upper extremity 41 and length L2 of lower extremity 42 and across outward corner 43. As length L1 of upper extremity 41 is substantially equal to height H of each riser 21 of stairs 11 illustrated in FIG. 1 and as opening 70 extends along length L1 of upper extremity 41, opening 70 extending along length L1 of upper extremity 41 is substantially equal to height H of each riser 21 of stairs 11. As length L2 of lower extremity 42 is substantially equal to width W of each tread 20 of stairs 11 illustrated in FIG. 1 and as opening 70 extends along length L2 of lower extremity 42, opening 70 extending along length L2 of lower extremity 41 is substantially equal to width W of each tread 20 of stairs 11. Accordingly, the length of opening 70 extending along length L1 of upper extremity 41 is chosen such that it is substantially equal to height H of each riser 21 of stairs 11, and the length of opening 70 extending along length L2 of lower extremity 42 is chosen such that it is substantially equal to width W of each tread 20 of stairs 11. Nozzle body 30 is hollow as shown in FIG. 2, and inner end 32 being the vacuum hose connecting end of conduit 31 of nozzle body 30 is connectable to a vacuum hose in the normal manner to apply suction through a suction pathway 72 defined by and through nozzle body 30 from opening 70 formed in business end 40 of nozzle body 30 to inner end 32 of nozzle body 30.

Nozzle 10 is uniquely structured and arranged to concurrently clean, through suction applied to nozzle 10 by a standard vacuum cleaner, a riser and a corresponding tread and the inward corner formed therebetween together forming a step of stairs 11 as shown in FIGS. 1 and 2. Nozzle 10 is formed by nozzle body 30, which includes business end 40 having opposed upper and lower extremities 41 and 42 forming angle A2 with one another at the outer end of business end 40 and meeting at outward corner 43, and upper and lower extremities 41 and 42 and outward corner 43 are to be concurrently applied to riser 21, tread 20, and the inward corner formed between the riser 21 and the corresponding tread 20, and unbroken front suction opening 70 is formed in upper extremity 41, lower extremity 42, and outward corner 42 to assure a concurrent suction along substantially the entire height H of riser 21, substantially the entire width W of the corresponding tread 20, and the inward corner formed between the riser 21 and the corresponding tread 20.

Referencing FIGS. 1 and 2 in relevant part, in the use of nozzle 10 inner end 32 of nozzle 10 is inserted into vacuum hose 34 thereby coupling nozzle 10 to vacuum hose 34 and to the vacuum, not shown, connected to vacuum hose 34. The outer end of business end 40 of nozzle 10 is concurrently applied to and along the height H of riser 21 and the width W of tread 20 and to the inward corner formed therebetween the riser 21 and the corresponding tread 20 to, in turn, concurrently apply opening 70 to and along the height H of riser 21 and the width W of tread 20 and the inward corner formed between riser 21 and tread 20, length L1 of upper extremity 41 of business end 40 to and along the height of riser, and length L2 of lower extremity to and along the width of tread 20. In a further and more specific aspect, front suction opening 70 is concurrently applied to and along the height H of riser 21 and the width W of tread 20 and the inward corner formed therebetween the riser 21 and the corresponding tread 20 by maneuvering nozzle 10 to concurrently apply outward corner 43 of business end 40 of nozzle 10 to the inward corner of the step to be cleaned formed at the intersection of inner edge 23 of tread 20 and lower edge 24 of the corresponding riser 21, marginal edges 55 and 56 of upper extremity 41 to and upwardly along height H of riser 21 from outward corner 43 to horizontal edge 57 at the upper end of upper extremity 41 of business end 40 of nozzle 10, and marginal edges 65 and 66 to and horizontally across width W of tread 20 from outward corner 43 to horizontal edge 67 at the outer end of lower extremity 42 of business end 40 of nozzle 10.

As length L1 of upper extremity 41 is substantially equal to height H of riser 21 of stairs 11 and as opening 70 extends along length L1 of upper extremity 41 applied to height H of riser 21, opening 70 extending along length L1 of upper extremity 41 also extends along or otherwise across substantially the entire height H of riser 21, in accordance with the principle of the invention. Moreover, as length L2 of lower extremity 42 is substantially equal to width W of tread 20 of stairs 11 and as opening 70 extends along length L2 of lower extremity 42 applied to width W of tread 20, opening 70 extending along length L2 of lower extremity 42 also extends along or otherwise across substantially the entire width W of tread 20, in accordance with the principle of the invention. With this application of nozzle 10 with respect to riser 21, tread 20, and the inward corner therebetween riser 21 and tread 20, application of suction through suction pathway 72 from opening 70 formed in the outer end of business end 40 of nozzle 10 to inner end 32 of nozzle 10 produces a currently cleaning of substantially the entire height H of riser 21, substantially the entire width W of tread 20, and the inward corner formed between riser 21 and the corresponding tread 20, in accordance with the principle of the invention. Nozzle 10 may be moved laterally across the tread 20 and the corresponding riser 21 for cleaning purposes.

As inward angle A1 formed between riser 21 and tread 20 is substantially 90 degrees, and outward angle A2 formed in the outer end of business end 40 of nozzle is substantially 270 degrees, outward angle A2 of nozzle 10 corresponds with or otherwise relates to inward angle A1 of the step to be cleaned. In the application of nozzle 10 to the riser 21 and corresponding tread 20 of the step as described in detail above, the related angles A1 and A2 in the step to be cleaned and nozzle 10, respectively, assures a concurrent application of opening 70 to substantially the entire height H of riser 21, substantially the entire width W of tread 20, and the inward corner formed between riser 21 and tread 20 to assure a concurrent cleaning through suction at opening 70 along substantially the entire height H of riser 21, substantially the entire width W of tread 20, and the inward corner formed between riser 21 and tread 20, in accordance with the principle of the invention. In the present example as best shown in FIG. 1, width W of tread 20 is greater than height H of riser 21, in which case length L2 of lower extremity 42 being substantially equal to width W of tread 20 is greater than or otherwise longer than length L1 of upper extremity 41 being substantially equal to height H of riser 21. Regardless of the length of the height of a riser and the width of the corresponding tread in a step to be cleaned, it is preferred that a nozzle constructed and arranged in accordance with the principle of the invention having an upper extremity 41 with a length L1 substantially equal to the height of the riser to be cleaned, and a lower extremity 42 with a length L2 substantially equal to the width of the tread to be cleaned, in accordance with the principle of the invention.

The present invention is described above with reference to a preferred embodiment. However, those skilled in the art will recognize that changes and modifications may be made in the described embodiment without departing from the nature and scope of the present invention. For instance, nozzle 10 may be fashioned with a brush or bristled features along the outer end thereof proximate to opening 70. Nozzle 10 may also be fashioned with wheels, bearings, or the like to allow nozzle 10 be rolled over a surface to be cleaned. Upper and lower extremities 41 and 42 of nozzle 10 may also be adjustable in length, such as with telescoping features, to permit them to be adjusted between shortened and lengthened conditions as needed to correspond to the height and length of the riser and corresponding tread of the step to be cleaned.

Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. In a stair structure including a horizontal tread, having a width, that meets a vertical riser, having a height, at an inward corner, and the width of the horizontal tread is greater than the height of the vertical riser, a vacuum cleaner nozzle, comprising:

a nozzle body including a business end having opposed upper and lower extremities forming an angle with one another and meeting at an outward corner, the opposed upper and lower extremities and the outward corner to be concurrently applied to the vertical riser, the horizontal tread, and the inward corner, respectively;

an unbroken front suction opening formed in the upper extremity, the lower extremity, and the outward corner;

the unbroken front suction opening has a first length extending along the upper extremity and a second length extending along the lower extremity; and the first length of the unbroken front suction opening is substantially equal to the height of the vertical riser, and the second length of the unbroken front suction opening of the lower extremity is longer than the first length of the unbroken front suction of the upper extremity and is substantially equal to the width of the horizontal tread being greater than the height of the vertical riser, so as to cause the unbroken front suction opening to provide a concurrent suction along substantially the entire height of the vertical riser from the first length of the unbroken front suction opening, substantially the entire width of the horizontal tread from the second length of the unbroken front suction opening, and the inward corner from the unbroken front suction opening at the outward corner of the nozzle body.

2. A vacuum cleaner nozzle according to claim 1, further comprising the front suction opening having a width that is substantially the same along the upper extremity, the lower extremity, and the outward corner.

3. A vacuum cleaner nozzle according to claim 2, wherein the nozzle body further includes a vacuum hose connecting end opposite to the business end.

4. In a stair structure including a horizontal tread, having a width, that meets a vertical riser, having a height, at an inward corner, and the width of the horizontal tread is greater than the height of the vertical riser, a vacuum cleaner nozzle, comprising:

a nozzle body including a business end having opposed upper and lower extremities forming an angle with one another and meeting at an outward corner, the opposed upper and lower extremities and the outward corner to be concurrently applied to the vertical riser, the horizontal tread, and the inward corner, respectively;

the upper extremity having a first length substantially equal to the height of the vertical riser;

the lower extremity having a second length that is longer than the first length of the upper extremity and that is substantially equal to the width of the horizontal tread being greater than the height of the vertical riser; and an unbroken front suction opening formed in the first length of the upper extremity, the second length of the lower extremity, and the outward corner to provide a concurrent suction along substantially the entire height of the vertical riser through the unbroken front suction opening from the first length of the upper extremity of the nozzle body, substantially the entire width of the horizontal tread through the unbroken front suction opening from the second length of the lower extremity of the nozzle body, and the inward corner through the unbroken front suction opening from the outward corner of the nozzle body.

5. A vacuum cleaner nozzle according to claim 4, further comprising the front suction opening having a width that is substantially the same along the first length of the upper extremity, the second length of the lower extremity, and the outward corner.

6. A vacuum cleaner nozzle according to claim 5, wherein the nozzle body further includes a vacuum hose connecting end opposite to the business end.

7. In a stair structure including a horizontal tread, having a width, that meets a vertical riser, having a height, at an inward corner, and the width of the horizontal tread is greater than the height of the vertical riser, a vacuum cleaner nozzle, comprising:

an integral nozzle body including a business end having opposed vertical and horizontal extremities forming an angle with one another and meeting at an outward corner, the opposed vertical and horizontal extremities and the outward corner to be concurrently applied to the vertical riser, the horizontal tread, and the inward corner, respectively;

the vertical extremity having a first length extending from the outward corner to a first outer end of the vertical extremity of the nozzle body;

the horizontal extremity having a second length extending from the outward corner to a second outer end of the horizontal extremity of the nozzle body;

the first length of the vertical extremity substantially equal to the height of the vertical riser;

the second length of the horizontal extremity is longer than the first length of the vertical extremity and is substantially equal to the width of the horizontal tread being greater than the height of the vertical riser; and an unbroken front suction opening formed in the first length of the vertical extremity, the second length of the horizontal extremity, and the outward corner to provide a concurrent suction along substantially the entire height of the vertical riser through the unbroken front suction opening from the first length of the vertical extremity of the nozzle body, substantially the entire width of the horizontal tread through the unbroken front suction opening from the second length of the horizontal extremity of the nozzle body, and the inward corner through the unbroken front suction opening from the outward corner of the nozzle body.

8. A vacuum cleaner nozzle according to claim 7, further comprising the front suction opening having a width that is substantially the same along the first length of the vertical extremity, the second length of the horizontal extremity, and the outward corner.

9. A vacuum cleaner nozzle according to claim 8, wherein the nozzle body further includes a vacuum hose connecting end opposite to the business end.

* * * * *